US007100477B2

(12) United States Patent
Lee

(10) Patent No.: US 7,100,477 B2
(45) Date of Patent: Sep. 5, 2006

(54) ONEWAY RATCHET WRENCH

(76) Inventor: Yi-Min Lee, No. 62, Renmei Rd., Dali City, Taichung County (TW) 412

( * ) Notice: Subject to any disclaimer, the term of this patent is extended or adjusted under 35 U.S.C. 154(b) by 58 days.

(21) Appl. No.: 10/901,598

(22) Filed: Jul. 28, 2004

(65) Prior Publication Data

US 2006/0162503 A1 Jul. 27, 2006

(51) Int. Cl.
*B25B 13/46* (2006.01)

(52) U.S. Cl. ..... 81/60; 81/58; 81/61

(58) Field of Classification Search ..... 81/60, 81/58, 61, 62, 63, 63.1, 63.2
See application file for complete search history.

(56) References Cited

U.S. PATENT DOCUMENTS 5,636,557 A * 6/1997 Ma ..... 81/60
6,807,882 B1 * 10/2004 Hu ..... 81/60

* cited by examiner

*Primary Examiner*—Lee D. Wilson
*Assistant Examiner*—Alvin J Grant
(74) *Attorney, Agent, or Firm*—Charles E. Baxley

(57) ABSTRACT

A oneway ratchet wrench includes a wrench body, a ratchet wheel, and a drive mechanism. The drive mechanism includes a support plate, a oneway pawl member, and an elastic member. Thus, the elastic member is mounted between the support plate and the oneway pawl member, so that the wall of the receiving recess of the drive head needs not to additionally provide a blind hole for mounting the elastic member, thereby facilitating assembly of the oneway ratchet wrench, and thereby decreasing costs of fabrication.

11 Claims, 5 Drawing Sheets

ONEWAY RATCHET WRENCH

BACKGROUND OF THE INVENTION

1. Field of the Invention

The present invention relates to a ratchet wrench, and more particularly to a oneway ratchet wrench.

2. Description of the Related Art

A conventional oneway ratchet wrench comprises a wrench body having a distal end formed with a drive head having an inside formed with a receiving hole having a side formed with a receiving recess having a wall formed with a blind hole, a ratchet wheel mounted in the receiving hole of the drive head, a oneway pawl member pivotally mounted in the receiving recess of the drive head and having a first side engaged with the ratchet wheel, and an elastic member mounted in the blind hole of the drive head and urged on a second side of the oneway pawl member.

However, the wall of the receiving recess of the drive head needs to additionally provide a blind hole for mounting the elastic member, thereby increasing costs of fabrication. In addition, the elastic member needs to align with the blind hole in the assembly process, thereby causing inconvenience in assembly of the conventional oneway ratchet wrench

SUMMARY OF THE INVENTION

The primary objective of the present invention is to provide a oneway ratchet wrench that is operated easily and conveniently.

Another objective of the present invention is to provide a one-way ratchet wrench, wherein the elastic member is mounted between the support plate and the oneway pawl member, so that the wall of the receiving recess of the drive head needs not to additionally provide a blind hole for mounting the elastic member, thereby facilitating assembly of the oneway ratchet wrench, and thereby decreasing costs of fabrication.

A further objective of the present invention is to provide a one-way ratchet wrench, wherein the elastic member has a force direction in line with a motional direction of the oneway pawl member, so that the engaging teeth of the oneway pawl member mesh with the ratchet teeth of the ratchet wheel exactly and smoothly, thereby facilitating a user operating the wrench body.

In accordance with the present invention, there is provided a oneway ratchet wrench, comprising:

a wrench body having a distal end formed with a drive head having an inside formed with a receiving hole having a side formed with a receiving recess;

a ratchet wheel mounted in the receiving hole of the drive head; and a drive mechanism mounted in the receiving recess of the drive head and including a support plate secured in the receiving recess of the drive head, a oneway pawl member pivotally mounted on the support plate and engaged with the ratchet wheel, and an elastic member mounted between the support plate and the oneway pawl member.

Further benefits and advantages of the present invention will become apparent after a careful reading of the detailed description with appropriate reference to the accompanying drawings.

DETAILED DESCRIPTION OF THE INVENTION

Figure 1:
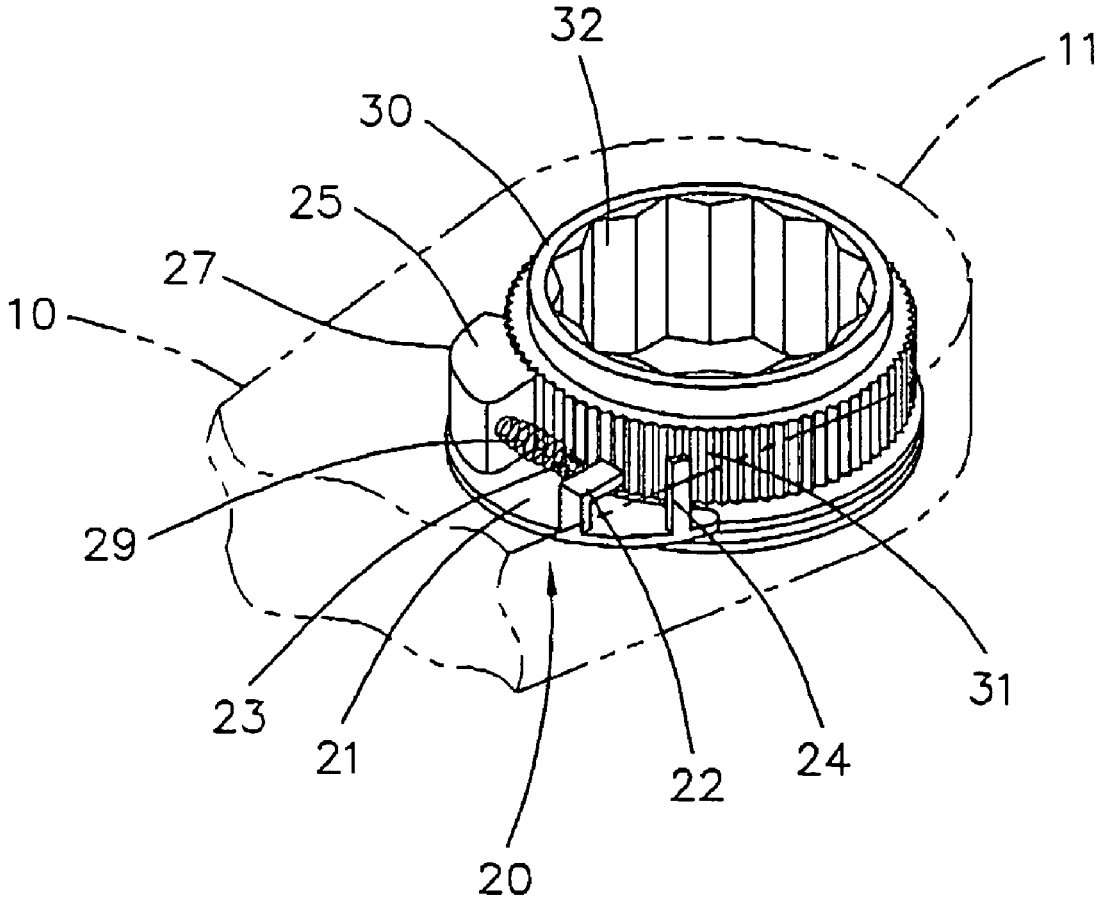
FIG. 1 is a partially cut-away perspective view of a oneway ratchet wrench in accordance with the preferred embodiment of the present invention.
Figure 2:
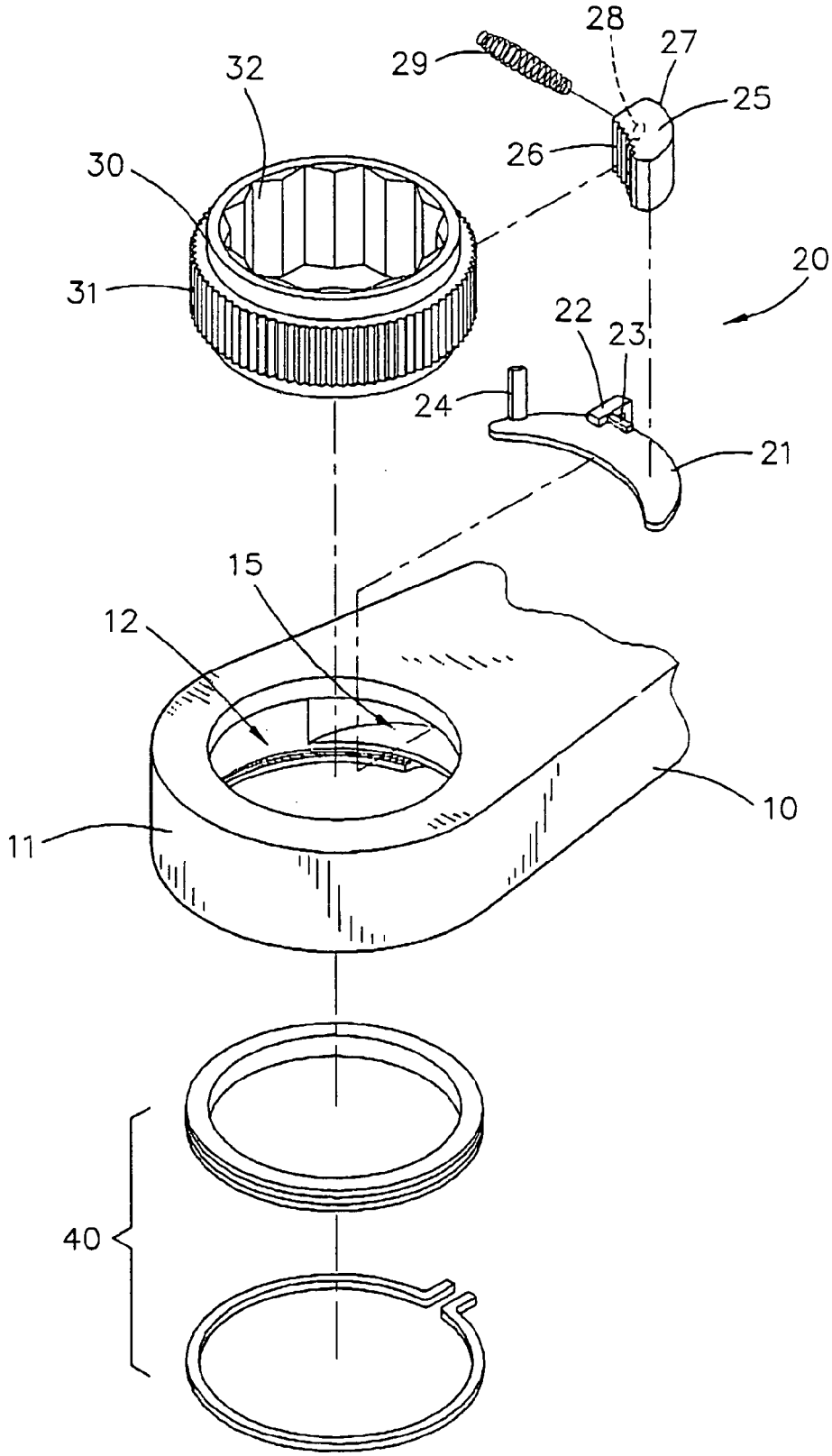
FIG. 2 is an exploded perspective view of the oneway ratchet wrench as shown in FIG. 1.
Figure 3:
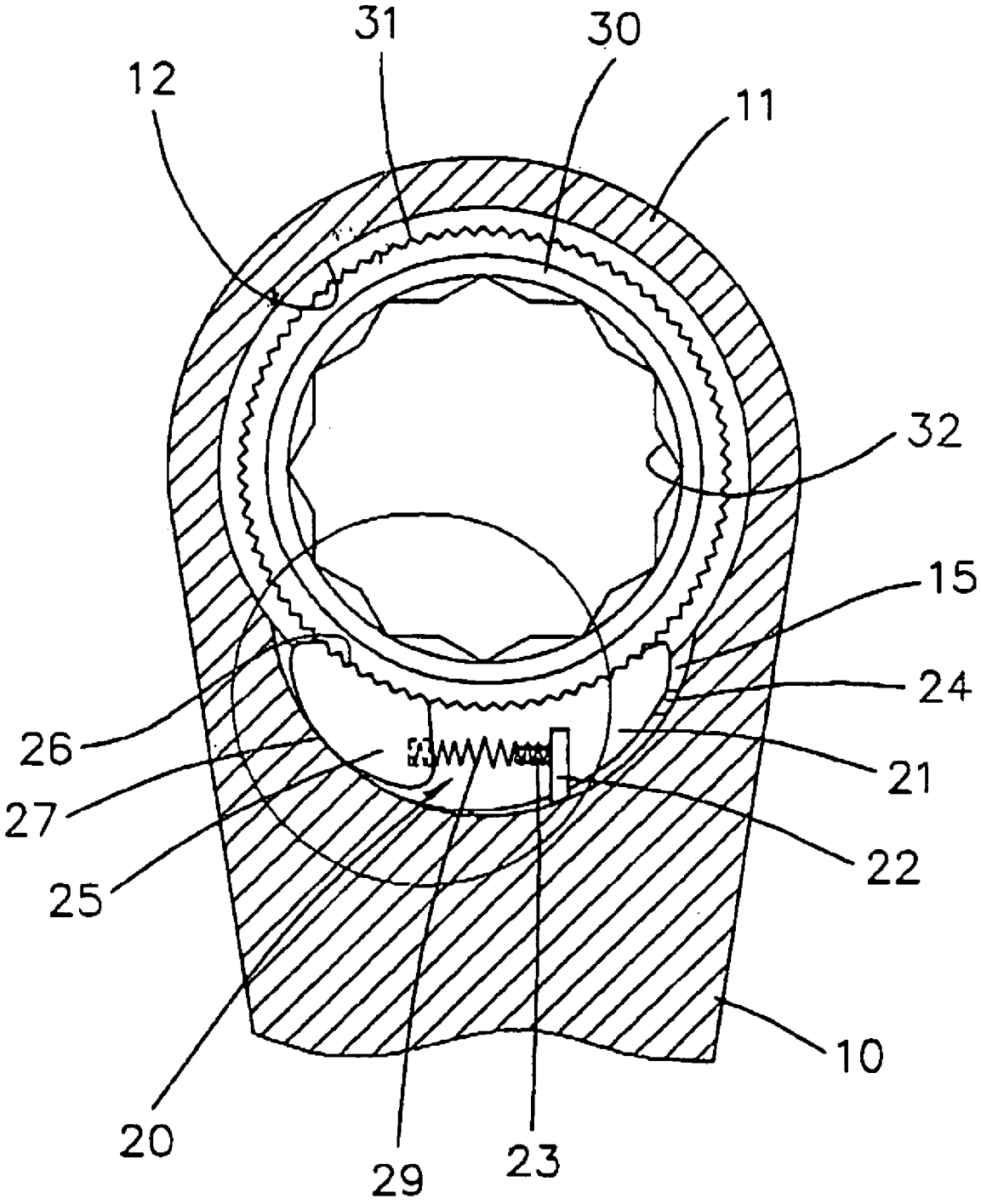
FIG. 3 is a top plan cross-sectional view of the oneway ratchet wrench as shown in FIG. 1.

Referring to the drawings and initially to FIGS. 1–3, a one-way ratchet wrench in accordance with the preferred embodiment of the present invention comprises a wrench body 10, a ratchet wheel 30, a drive mechanism 20, and a snapping mechanism 40.

The wrench body 10 has a distal end formed with a drive head 11 having an inside formed with a receiving hole 12 having a side formed with an arc-shaped receiving recess 15.

The ratchet wheel 30 is mounted in the receiving hole 12 of the drive head 11 and has an outer wall formed with a plurality of ratchet teeth 31 and an inner wall formed with a polygonal locking hole 32.

The drive mechanism 20 is mounted in the receiving recess 15 of the drive head 11 and includes an arc-shaped support plate 21 closely secured in the receiving recess 15 of the drive head 11, a oneway pawl member 25 pivotally mounted on the support plate 21 and engaged with the ratchet wheel 30, and an elastic member 29 mounted and urged between the support plate 21 and the oneway pawl member 25.

The support plate 21 of the drive mechanism 20 has a mediate portion formed with a substantially inverted L-shaped support bracket 22 extended toward the ratchet wheel 30. The support bracket 22 of the support plate 21 is formed with a protruding mounting bar 23 extended toward the oneway pawl member 25.

The oneway pawl member 25 of the drive mechanism 20 has a first side formed with a plurality of engaging teeth 26 meshing with the ratchet teeth 31 of the ratchet wheel 30 and a second side formed with an arc-shaped resting face 27 rested on a wall of the receiving recess 15 of the drive head 11. The oneway pawl member 25 of the drive mechanism 20 has an end formed with a mounting recess 28 facing the mounting bar 23 of the support bracket 22 of the support plate 21. The oneway pawl member 25 of the drive mechanism 20 is pivotally mounted on a first end of the support plate 21, and the support plate 21 has a second end formed with a protruding resting bar 24 rested on the wall of the receiving recess 15 of the drive head 11, so that the support plate 21 is mounted in the receiving recess 15 of the drive head 11 rigidly and stably.

The elastic member 29 of the drive mechanism 20 has a first end mounted on the mounting bar 23 of the support bracket 22 of the support plate 21 and a second end mounted in the mounting recess 28 of the one-way pawl member 25. The elastic member 29 of the drive mechanism 20 is preferably a double-cone shaped compression spring having two reduced ends to produce a stress having a longitudinal tensile effect and a transverse restoring effect.

The snapping mechanism 40 is mounted on a side of the ratchet wheel 30 and rested on a side of the drive head 11 of the wrench body 10 to retain the ratchet wheel 30 on the drive head 11 of the wrench body 10.

Figure 4:
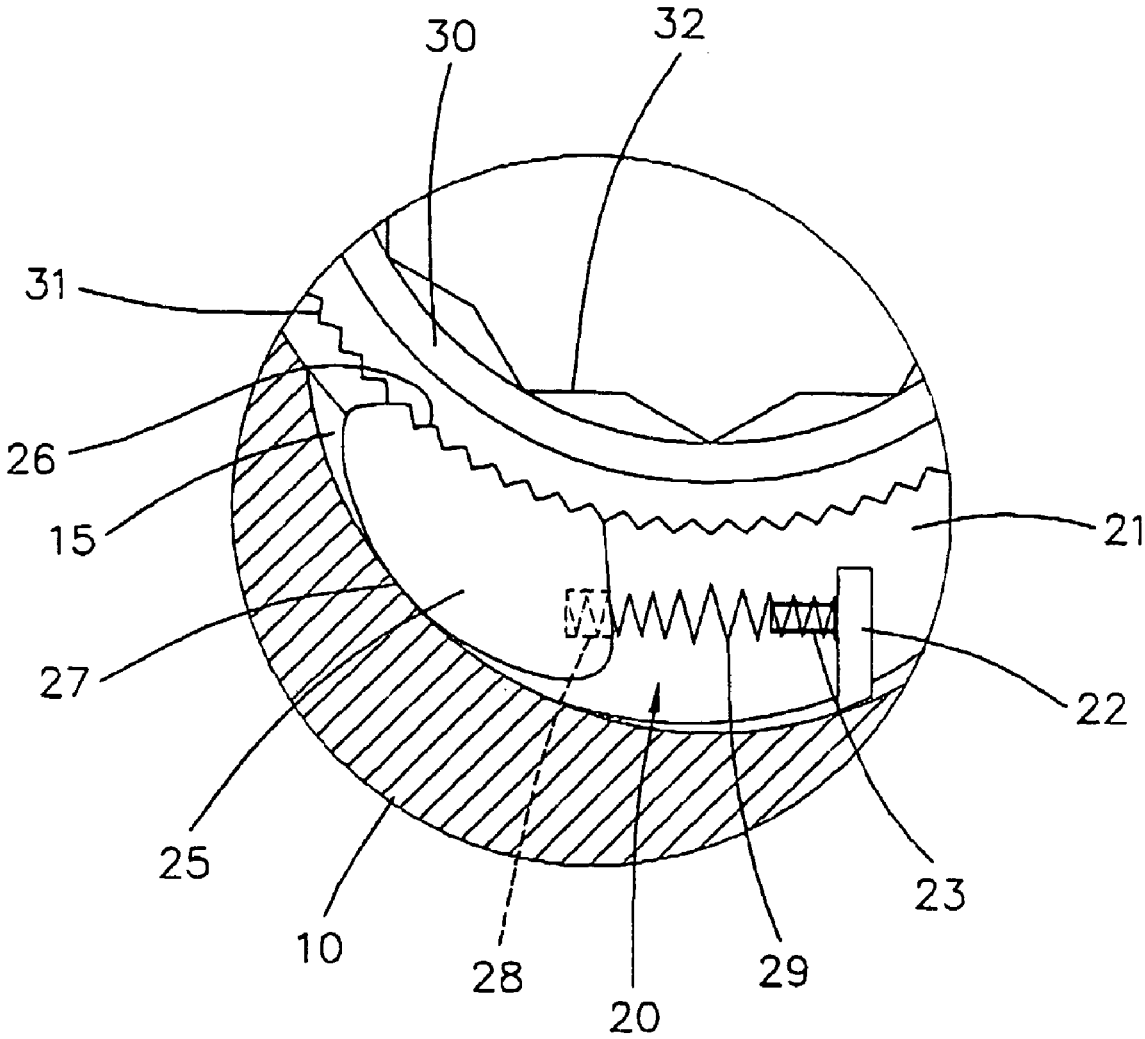
FIG. 4 is a partially enlarged view of the oneway ratchet wrench as shown in FIG. 3.
Figure 5:
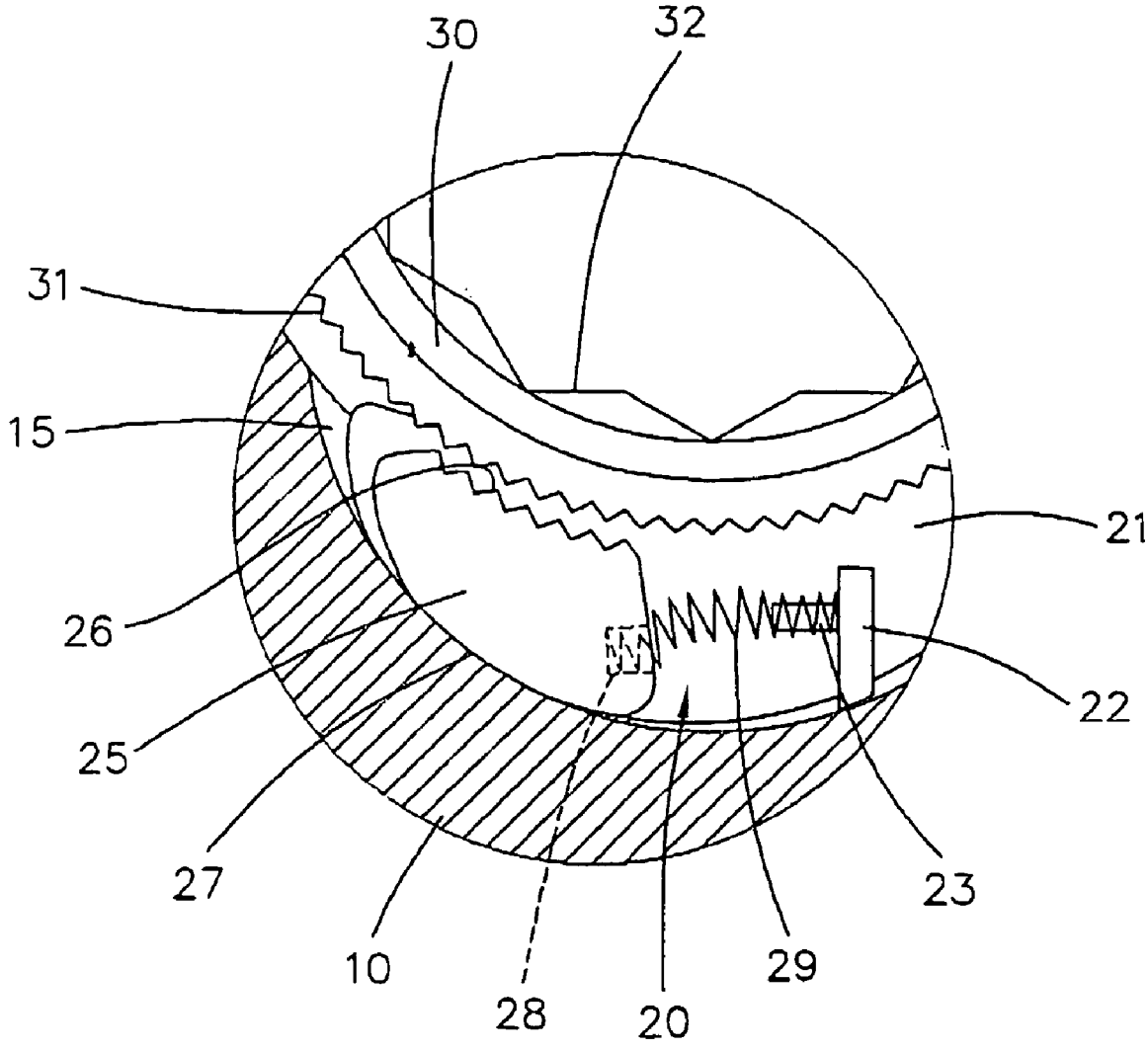
FIG. 5 is a schematic operational view of the oneway ratchet wrench as shown in FIG. 4.

In operation, referring to FIGS. 4 and 5 with reference to FIGS. 1–3, when the drive head 11 of the wrench body 10 is rotated in a normal (forward) direction, the ratchet teeth 31 of the ratchet wheel 30 mesh with the engaging teeth 26 of the oneway pawl member 25, so that the ratchet wheel 30 drives the oneway pawl member 25 to press the wall of the receiving recess 15 of the drive head 11. Thus, the ratchet wheel 30 is combined with the drive head 11 by the oneway pawl member 25, so that the ratchet wheel 30 is rotated with the drive head 11 to rotate a workpiece (not shown) mounted in the locking hole 32 of the ratchet wheel 30 in the normal direction as shown in FIG. 4.

At this time, the elastic member 29 has a force direction in line with a motional direction of the oneway pawl member 25, so that the engaging teeth 26 of the oneway pawl member 25 mesh with the ratchet teeth 31 of the ratchet wheel 30 exactly and smoothly, thereby facilitating a user operating the wrench body 10.

Alternatively, when the drive head 11 of the wrench body 10 is rotated in a reverse (backward) direction, the ratchet wheel 30 drives the oneway pawl member 25 to move backward to detach from the wall of the receiving recess 15 of the drive head 11, thereby detaching the engaging teeth 26 of the oneway pawl member 25 from the ratchet teeth 31 of the ratchet wheel 30 as shown in FIG. 5, so that the ratchet wheel 30 idles. At this time, the elastic member 29 is compressed by the oneway pawl member 25 and disposed at a slightly bent state to store its restoring force, so that when the drive head 11 of the wrench body 10 is rotated in the forward direction again, the oneway pawl member 25 is pushed by the restoring force of the elastic member 29 to return to the original position exactly and rapidly.

Accordingly, the elastic member 29 is mounted between the support plate 21 and the oneway pawl member 25, so that the wall of the receiving recess 15 of the drive head 11 needs not to additionally provide a blind hole for mounting the elastic member 29, thereby facilitating assembly of the oneway ratchet wrench, and thereby decreasing costs of fabrication. In addition, the elastic member 29 has a force direction in line with a motional direction of the oneway pawl member 25, so that the engaging teeth 26 of the oneway pawl member 25 mesh with the ratchet teeth 31 of the ratchet wheel 30 exactly and smoothly, thereby facilitating a user operating the wrench body 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A oneway ratchet wrench, comprising:

a wrench body having a distal end formed with a drive head having an inside formed with a receiving hole having a side formed with a receiving recess;

a ratchet wheel mounted in the receiving hole of the drive head; and a drive mechanism mounted in the receiving recess of the drive head and including a support plate secured in the receiving recess of the drive head, a oneway pawl member pivotally mounted on the support plate and engaged with the ratchet wheel, and an elastic member mounted between the support plate and the oneway pawl member;

wherein the support plate of the drive mechanism has a mediate portion formed with a support bracket formed with a protruding mounting bar, the oneway pawl member of the drive mechanism has an end formed with a mounting recess, and the elastic member of the drive mechanism has a first end mounted on the mounting bar of the support bracket of the support plate and a second end mounted in the mounting recess of the oneway pawl member.

2. The oneway ratchet wrench in accordance with claim 1, wherein the support bracket of the support plate is substantially inverted L-shaped.

3. The oneway ratchet wrench in accordance with claim 1, wherein the support bracket of the support plate is extended toward the ratchet wheel.

4. The oneway ratchet wrench in accordance with claim 1, wherein the mounting bar of the support bracket of the support plate is extended toward the oneway pawl member.

5. The oneway ratchet wrench in accordance with claim 1, wherein the mounting recess of the oneway pawl member faces the mounting bar of the support bracket of the support plate.

6. The oneway ratchet wrench in accordance with claim 1, wherein the receiving recess of the drive head is arc-shaped.

7. A oneway ratchet wrench, comprising:

a wrench body having a distal end formed with a drive head having an inside formed with a receiving hole having a side formed with a receiving recess;

a ratchet wheel mounted in the receiving hole of the drive head; and a drive mechanism mounted in the receiving recess of the drive head and including a support plate secured in the receiving recess of the drive head, a oneway pawl member pivotally mounted on the support plate and engaged with the ratchet wheel, and an elastic member mounted between the support plate and the oneway pawl member;

wherein the support plate of the drive mechanism is arc-shaped.

8. The oneway ratchet wrench in accordance with claim 1, wherein the ratchet wheel has an outer wall formed with a plurality of ratchet teeth, and the oneway pawl member of the drive mechanism has a first side formed with a plurality of engaging teeth meshing with the ratchet teeth of the ratchet wheel and a second side formed with an arc-shaped resting face rested on a wall of the receiving recess of the drive head.

9. A oneway ratchet wrench, comprising:

a wrench body having a distal end formed with a drive head having an inside formed with a receiving hole having a side formed with a receiving recess;

a ratchet wheel mounted in the receiving hole of the drive head; and a drive mechanism mounted in the receiving recess of the drive head and including a support plate secured in the receiving recess of the drive head; a oneway pawl member pivotally mounted on the support plate and engaged with the ratchet wheel, and an elastic member mounted between the support plate and the oneway pawl member;

wherein the oneway pawl member of the drive mechanism is pivotally mounted on a first end of the support plate;

the support plate has a second end formed with a protruding resting bar rested on the wall of the receiving recess of the drive head.

10. The oneway ratchet wrench in accordance with claim 1, wherein the elastic member of the drive mechanism is a double-cone shaped compression spring having two reduced ends.

11. The oneway ratchet wrench in accordance with claim 1, wherein the elastic member has a force direction in line with a motional direction of the oneway pawl member.

* * * * *